US005741097A

United States Patent [19]

Murphy, II

[11] Patent Number: 5,741,097

[45] Date of Patent: Apr. 21, 1998

[54] HEAT EXCHANGER FIN REMOVER

[76] Inventor: John W. Murphy, II, 202 Beach Ave., Woodbury Heights, N.J. 08097-1209

[21] Appl. No.: 665,672

[22] Filed: Jun. 20, 1996

[51] Int. Cl.[6] ..... B23C 3/00

[52] U.S. Cl. ..... 409/180; 408/80; 408/145; 408/201; 408/204

[58] Field of Search ..... 408/79, 80, 201, 408/204, 207, 209, 145, 703; 409/138, 180, 234; 451/541, 544, 545; 29/890.031

[56] References Cited

U.S. PATENT DOCUMENTS

| | | | |
|---|---|---|---|
| 1,825,277 | 9/1931 | Lytle . | |
| 3,243,924 | 4/1966 | Peters | 51/356 |
| 4,060,333 | 11/1977 | White | 408/103 |
| 4,691,600 | 9/1987 | Carlson et al. | 408/80 |
| 4,968,189 | 11/1990 | Pidgeon | 408/204 |
| 5,009,553 | 4/1991 | Nowman | 408/1 R |
| 5,069,584 | 12/1991 | Obermeier et al. | 408/145 |
| 5,316,416 | 5/1994 | Kim | 408/204 |
| 5,356,248 | 10/1994 | Hillestad | 408/80 |
| 5,413,437 | 5/1995 | Bristow | 408/204 |

FOREIGN PATENT DOCUMENTS

| | | |
|---|---|---|
| 0480263 | 9/1991 | Germany . |
| 529910 | 1/1972 | Russian Federation . |
| 816759 | 6/1979 | Russian Federation . |

*Primary Examiner*—Daniel W. Howell
*Attorney, Agent, or Firm*—Lennox & Murtha, P.A.

[57] ABSTRACT

A heat exchanger fin remover includes a first hollow cylindrically shaped member having a closed end and an open end. The closed end is provided with a centrally disposed portion including a centrally disposed threaded aperture adapted to be received by a rotary source of power. The first member open end is provided with an annular cutting ring portion disposed of the distal edge thereof. A second cylindrically-shaped member has a first end and second end adapted to be received within the first hollow cylindrically-shaped member open end. A threaded centrally disposed extending portion is adapted to be received by and cooperate with the first member centrally disposed threaded aperture when the second member is inserted into the first member. The second member other end extends beyond the cutting ring portion disposed on the distal edge of the first member.

7 Claims, 6 Drawing Sheets

HEAT EXCHANGER FIN REMOVER

BACKGROUND OF THE INVENTION

The present invention relates to a heat exchanger fin remover and method for use thereof, and more specifically, to a boiler tube fin remover. A heat exchanger, frequently used with large boilers, is generally provided with a number of extending tubes wherein the fin material is frequently made from carbon steel, 1.25 percent chromium or stainless steel. The tube material itself is either stainless steel, with chromium levels in the range of 1.25 to 2.25 percent, or carbon steel, depending on the temperature of the application. The extending tube lengths can vary depending on the size of the boiler from ten feet to a hundred feet. When a defect occurs in one of the tubes, it must be repaired or the fluids flowing within the tube would spray into the atmosphere. The fluid could be liquid steam, or possibly heated liquids, depending upon the particular application When damages such as leaks occur it is necessary to shut the boiler down, reducing the pressure in the tubes so that repairs can be made. The process of cutting out the damaged portion of the tube must be done carefully without weakening nearby sections of the tubes and replacing the damaged portion with a new undamaged portion, is very time consuming and labor intensive. The major difficulty occurs when removing the spiral slotted finned portion which is welded onto the tubes so that a replacement tube can be placed in the area where the damaged portion had been removed. The present method of removal of fins from boiler tubes uses a reciprocal saw requiring multiple passes, an oxy-acetylene torch also requiring many passes, or other devices and methods requiring multiple steps and suffering from the problems mentioned above while avoiding weakening the tubes as gouging the tubes can not be tolerated.

There are many tools suitable for drilling a hole in hard plate utilizing diamond grit bonded in a matrix to the periphery of the work-drilling end and a beeswax core in the hollow working end, such as disclosed in U.S. Pat. No. 5,009,553 issued to Nowman on Apr. 23, 1991.

Another tool utilizing an impregnated diamond drill bit having a generally cylindrical, hollow crown structure with a lower portion containing diamond particles and a steel shank attached to the crown structure at the upper end is disclosed in U.S. Pat. No. 4,274,769 issued to Multakh on Jun. 23, 1981. Still another improved core drill and core drill element includes at least one cutting element attached to one end of a drill tube is disclosed in U.S. Pat. No. 4,208,154 issued to Fundy on Jun. 17, 1980. Each of these devices are capable of cutting into hardened material. However, the ability to rapidly and economically remove the fins from boiler tube heat exchangers is not disclosed therein.

In order to overcome the problem of positioning a tool capable of drilling into hardened material and maintaining accuracy while cutting away the material at depths of at least three inches the device as disclosed herein, proves to be far superior.

SUMMARY OF INVENTION

An object of the present invention is to provide an improved and efficient heat exchanger fin remover that is reliable and easy to use.

Another object of the present invention is to provide a drill bit capable of cutting hardened material to depths approaching three inches, thereby removing heat exchanger fins.

A further object of the present invention is to provide an apparatus for removing hardened fins from boiler tubes in a relatively short period of time.

A yet further object of the present invention is to provide a simplified method of removing the fins from boiler tubes, suitable for various tube sizes.

According to the principles of the present invention, a heat exchanger fin remover includes a first hollow cylindrically-shaped member having a closed end and an open end. The closed end is provided with a centrally disposed portion with centrally disposed threaded aperture adapted to be received by a rotary source of power. The first member open end is provided with an annular cutting ring portion disposed on the distal edge thereof. A second cylindrically-shaped member has a first end and a second end, the first end is adapted to receive within said first member hollow open end. The second member first end is provided with a threaded centrally disposed extending portion adapted to be received by and cooperate with the centrally disposed first member threaded aperture when it is inserted therein. The second member other end extends beyond the cutting ring portion disposed on the distal edge of the first member.

Another aspect of the inventions is a method of removing the fins from a heat exchanger tube to replace a damaged portion thereof. The method includes the steps of locating the damaged portion of a finned heat exchanger tube and cutting along the transverse axis of said heat exchanger tube before and after said damaged portion to remove said damaged portion. The method then includes cutting the fins off both open ends of said heat exchanger tube in a single continuous operation, preferably using the fin remover described herein above. The method then includes replacing said damaged portion with a new undamaged tube portion having two ends, one end of said undamaged tube portion being adapted to be received by each of said both open ends of said heat exchanger tube forming a continuous tube; and affixing both ends of said new undamaged tube portion to said both open ends of said heat exchanger tube.

The foregoing and other objects and advantages will appear from the description to follow. In the description reference is made to the accompanying drawing which forms a part hereof and in which is shown by way of illustration to a specific embodiment in which the invention may be practiced. This embodiment will be described in sufficient detail to enable those skilled in the art to practice the invention and it is to be understood that other embodiment may be utilized and that structural change may be made without departing from the scope of the invention. The following detailed description is, therefore, not be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which.

DESCRIPTION OF PREFERRED EMBODIMENTS

Figure 1:
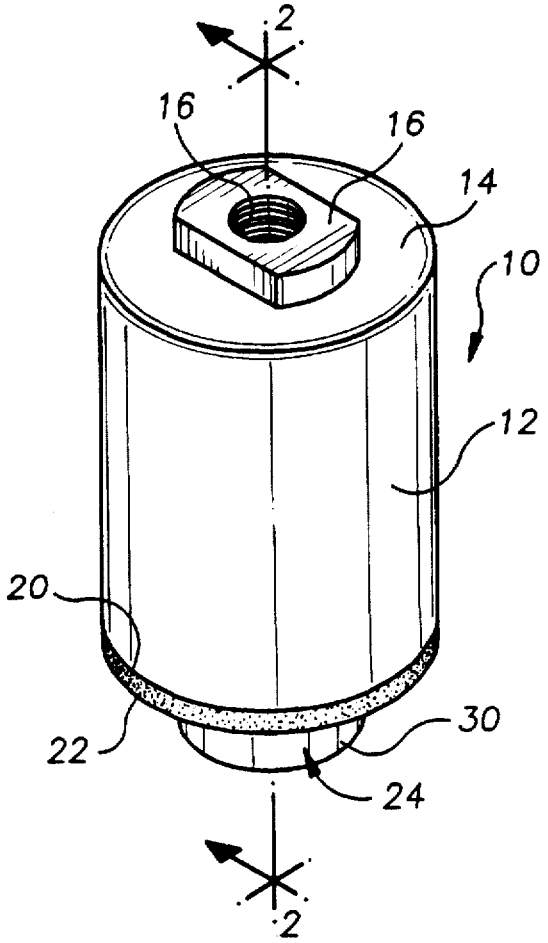
FIG. 1 is a front perspective view of a heat exchanger fin remover, according to the principles of the present invention.

Referring now to the figures, and in particular to FIGS. 1 through 4, there is shown a heat exchanger fin remover 10, according to the principles of the present invention, which is seen to have a cylindrically-shaped hollow first member 12 that is provided with a closed end 14 provided with a centrally disposed portion 16 that is provided with a threaded aperture 18. The centrally disposed portion 16 is shaped to be received into a chuck, not shown, of a rotary source of power, e.g., commercially available portable milling machines, such as ESCO Model No. HHB 5000, or a common one-half inch electric drill. The open end 20 of member 12 has affixed thereon an annular ring cutting portion 22 which is preferably diamond impregnated or, alternatively, a hardened carbon steel toothed member suitable for cutting relatively hard materials. There need be no cutting capability on the inside surface of member 12 and cutting portion 22 need extend no further than about 1/16 inch on the outside of member 12.

Figure 2:
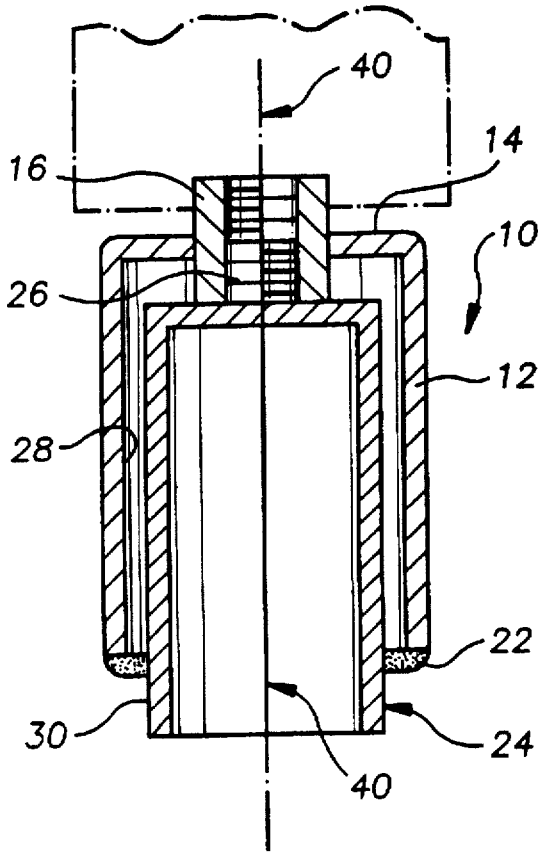
FIG. 2 is a cross sectional view taken along the line 2—2 of FIG. 1.
Figure 2A:
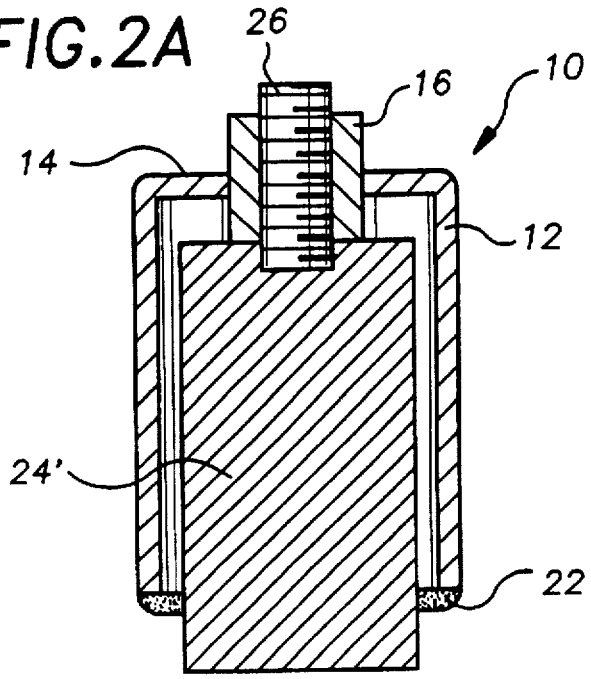
FIG. 2A is a cross sectional view along the line 2—2 of FIG. 1 showing an alternative embodiment.
Figure 6:
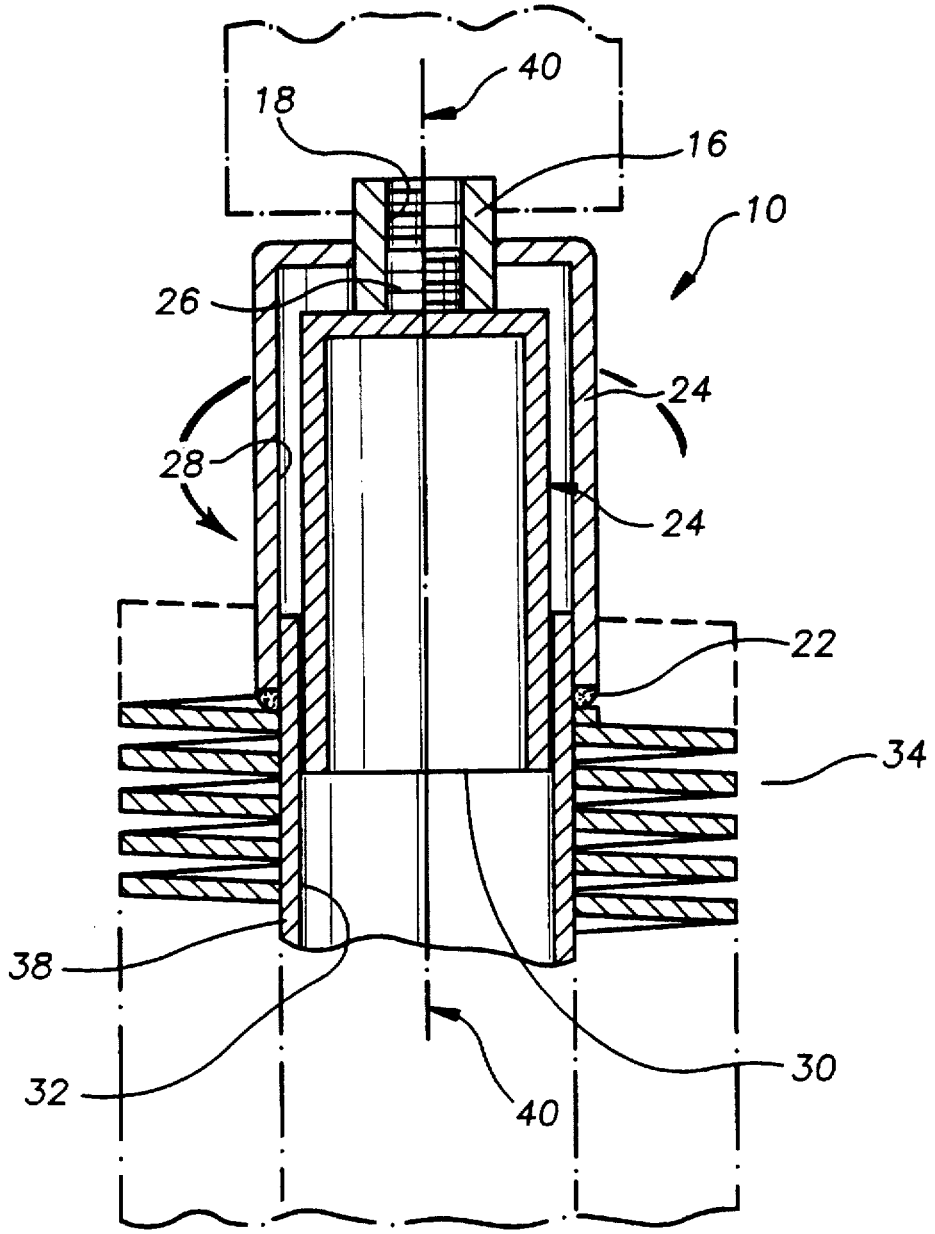
FIG. 6 is a cross-sectional view taken along line 6—6 of FIG. 1.

Inserted within the hollow housing 12 is a second member 24 which extends beyond the ring 22 of the first member 12. The second member 24 is preferably hollow as shown in FIG. 2 or, alternatively, may be solid as shown in FIG. 2A. The difference between inside diameter of housing 12 and member 24 is the thickness of the boiler tube to be shorn of the fins plus about 0.030 inch for clearance. The clearance must be sufficient to provide sufficient control while limiting the amount of frictional heat buildup. The hollow version member 24 is preferred to better dissipate heat during the cutting process and internal surface modifications to further improve heat dissipation may be added. The second member 24 on one end is provided with an externally threaded extending portion 26 adapted to be received by and cooperate with the threaded aperture 18 provided in the first member centrally closed end portion 16, when the second member 24 is inserted in the opening 28 the first member 12. The other end 30 of the second member 24 extends beyond the ring portion 22 of the first member 12 and acts as a pilot to accurately position the cutting ring portion 22 of the first member 12, as shown in FIG. 6.

Figure 5:
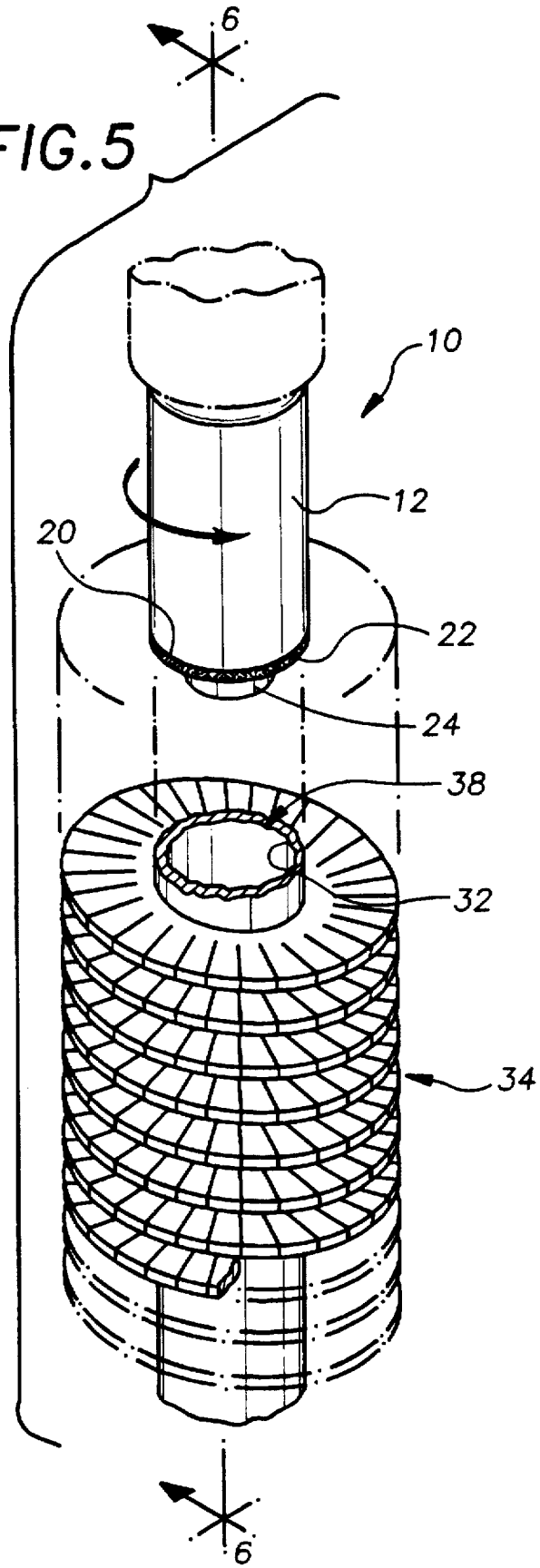
FIG. 5 is an exploded pictorial representation of the fin remover shown in FIG. 1 as it is being inserted into a heat exchanger tube for the purpose of removing the fins affixed thereon.
Figure 3:
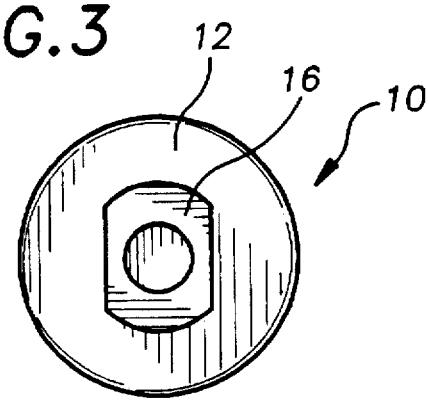
FIG. 3 is a top plan view of the fin remover shown in FIG. 1.
Figure 4:
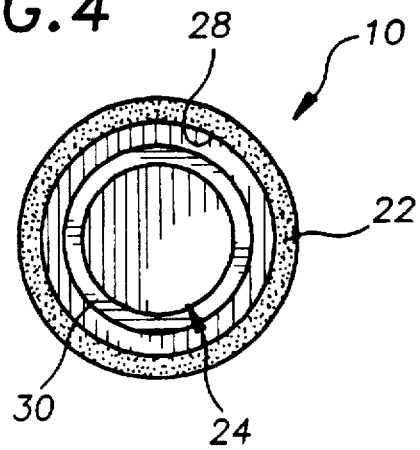
FIG. 4 is a bottom plan view of the fin remover shown in FIG. 1.

FIG. 5 is an exploded view of the heat exchanger fin remover 10 as it is being inserted into the tube opening 32 of a heat exchanger 34, which has a plurality of fins 36 welded on the central tube member 38. The fins 36 are generally spiral in nature, extending the full length of the tube 38. The instant fin remover 10, as shown in FIG. 6, will work equally as well if the fins 36 are individually welded on the tube 38.

It is to be noted that the second member 24 functions as a pilot for the first member 12 maintaining the alignment along the longitudinal axis of the tube 38.

It is to be noted that the number of tins 36 that can be removed depends upon the length of the first member 12. In order to ensure that the cutting of the fins is uniform, the second member 24 is provided with a smaller external diameter than the inner diameter of the opening 28 provided in the first member 12 so that the spacing between the two diameters is approximately equal to the thickness of the tube 38. Thus, if different tube thicknesses are to have their fins removed the second member 24 will require that the external diameter thereof be changed by replacing it with another member or pilot so that the external diameter of the second member 24 engages the opening 32 of the tube 38.

Referring now to FIGS. 7, 8, 9, and 10 which depicts the method used for repairing a defective tube of a heat exchanger 34.

Figure 7:
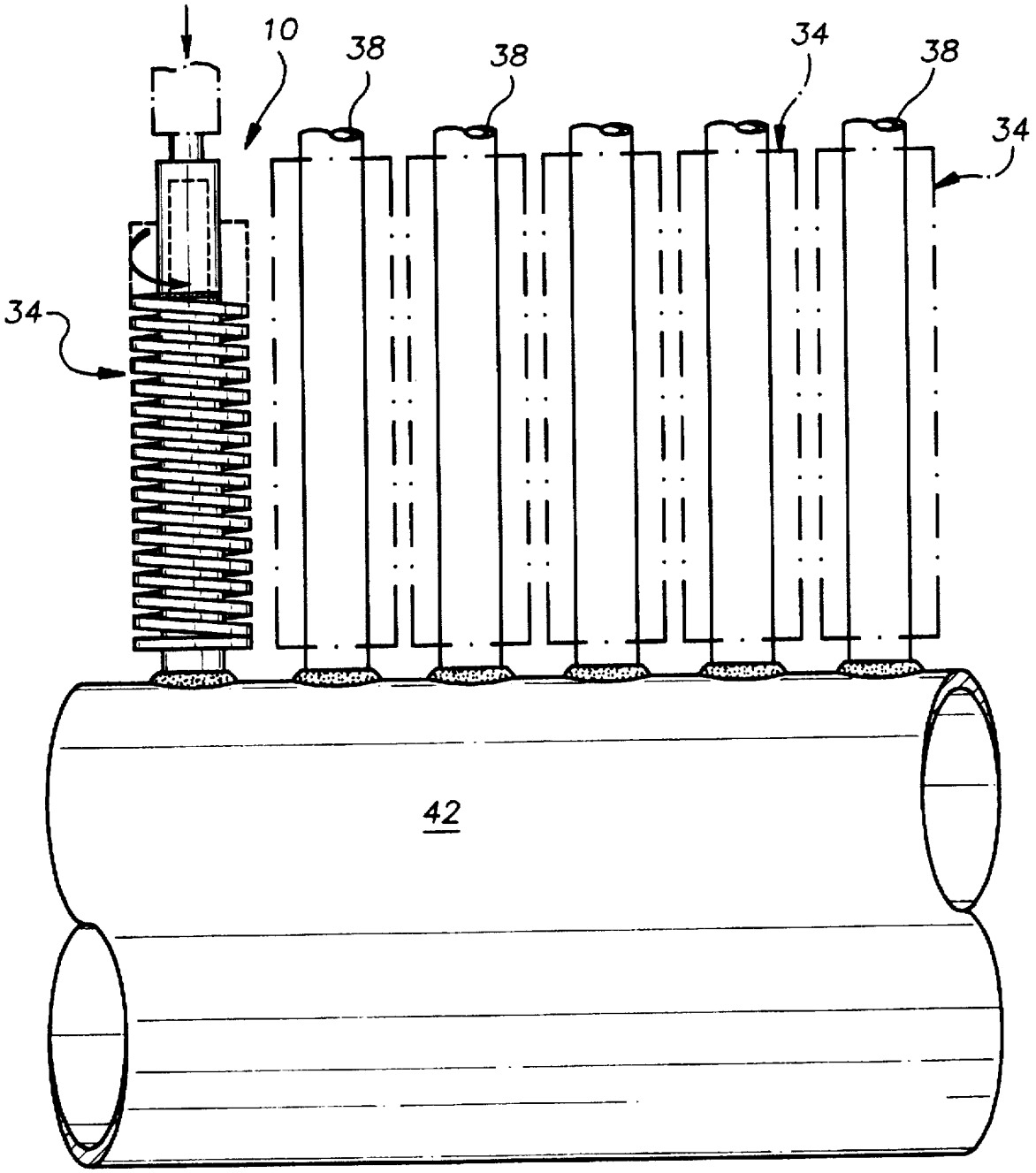
FIG. 7 is a reduced partial pictorial representation of a portion of a boiler having a plurality of heat exchanger tubes with fins exposed affixed thereto.
Figure 8:
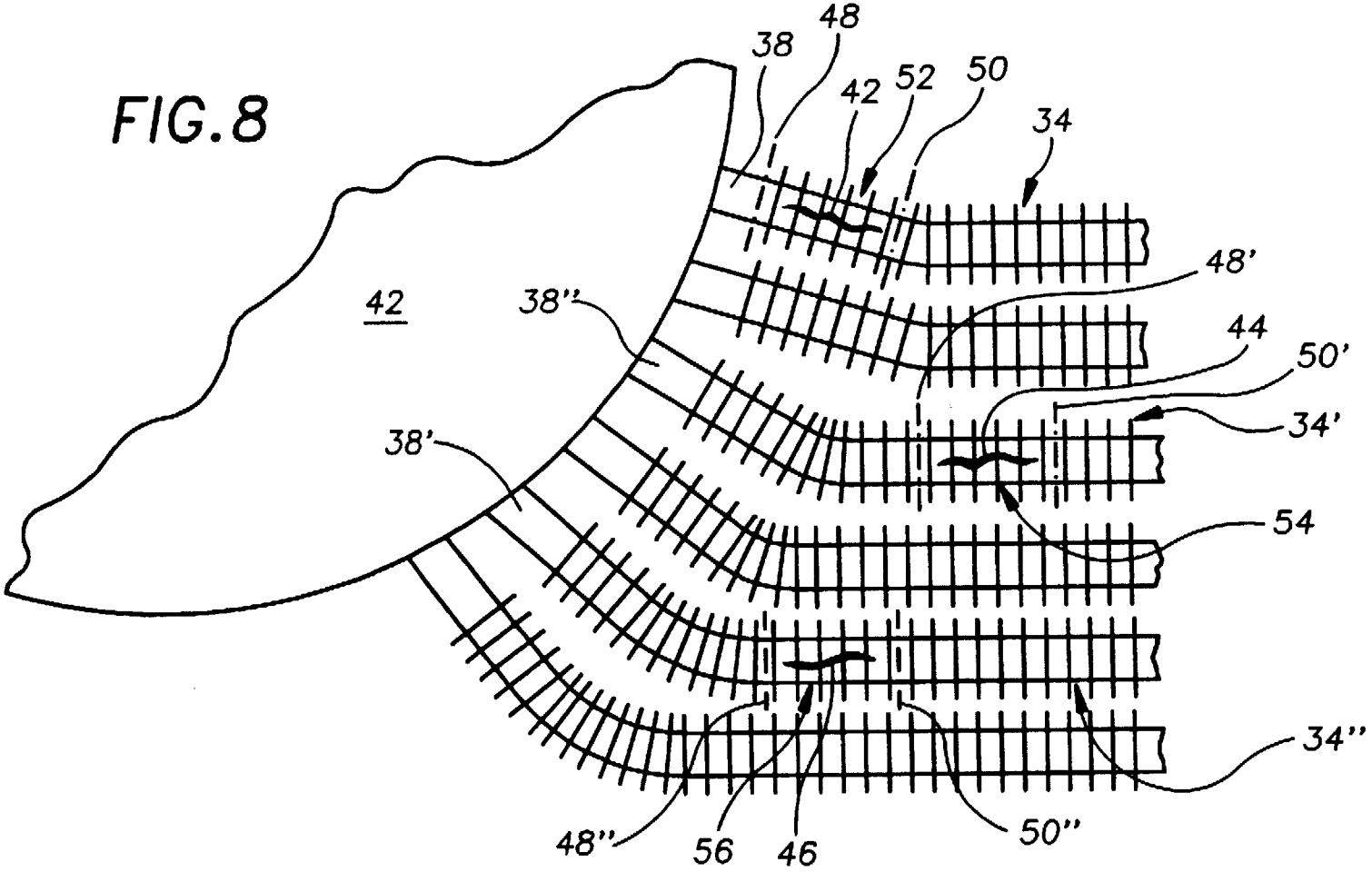
FIG. 8 is a partial pictorial representation of a boiler with a plurality of the heat exchanger tube members having defects therein.
Figure 9:
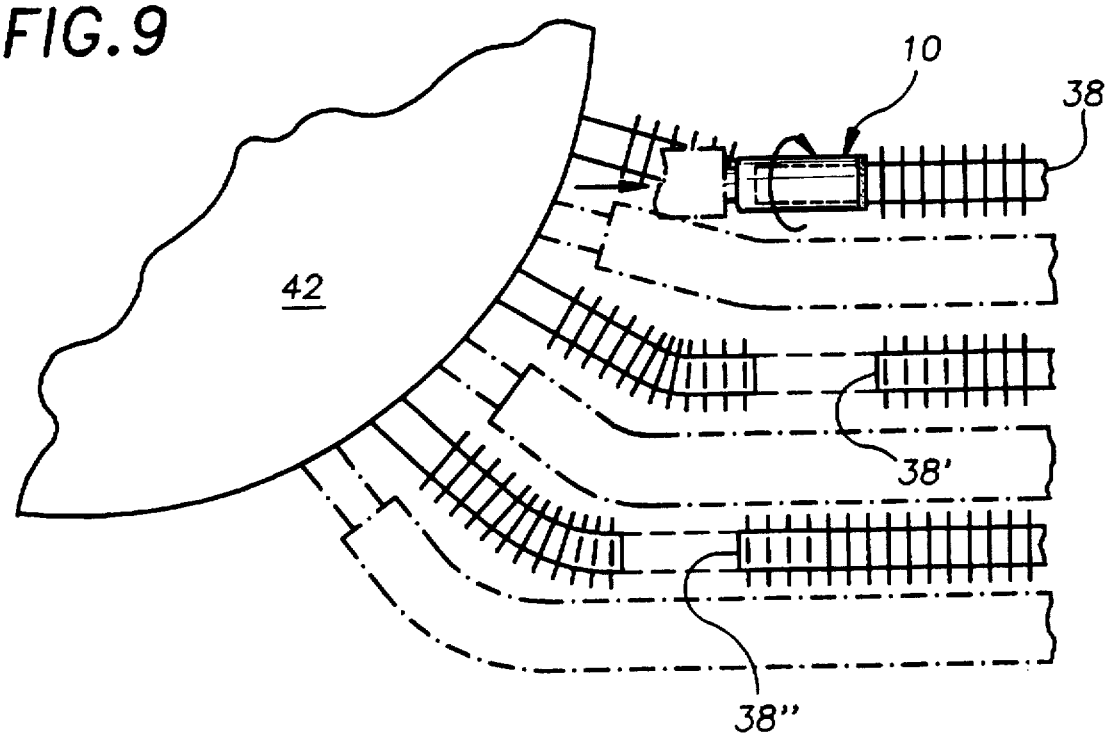
FIG. 9 is a partial pictorial representation of the heat exchanger fin remover positioned on a tube to remove the heat exchanger fins.
Figure 10:
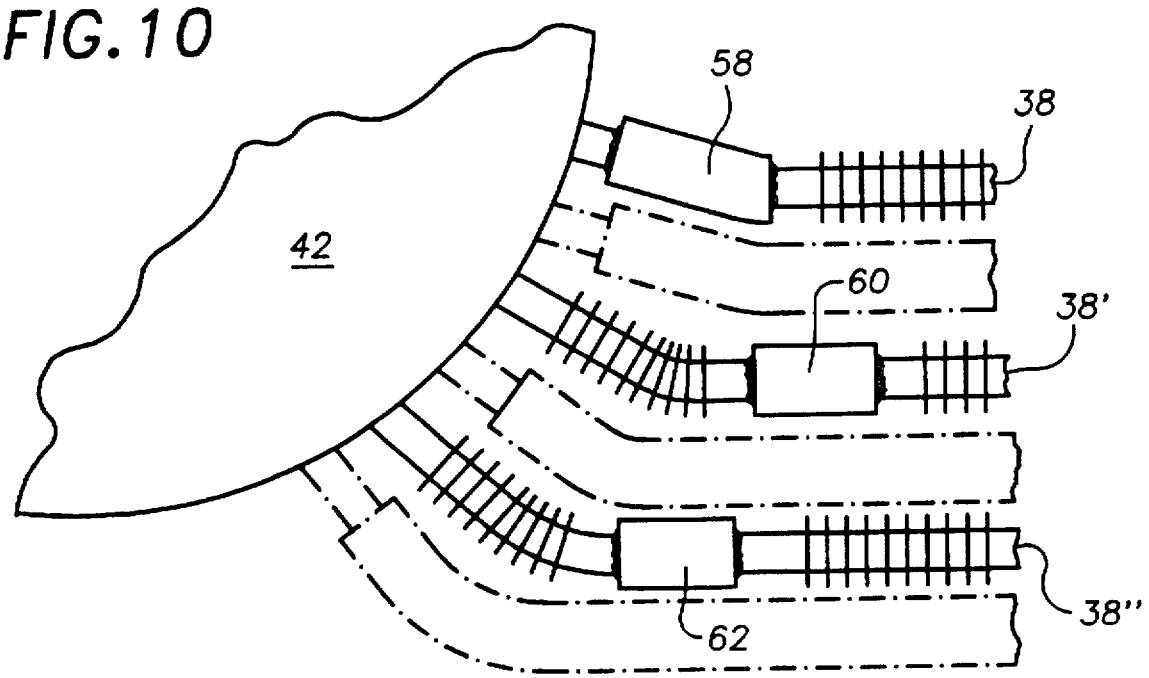
FIG. 10 is a partial pictorial representation of the replacement portions welded on the heat exchanger tubes in the area of the defective portions that have been removed.

In operation, FIG. 8 shows the extending heat exchangers 34, 34', 34" which extend from a boiler 42, partially broken away. Defects 42, 44, and 46 are shown in tubes 34, 34', and 34", respectively, which must be repaired. Cuts made transverse to the longitudinal axis 40 are made as shown by the broken lines 48 and 50; 48' and 50' and 48" and 50" thereby removing the defective portions 52, 54, and 56, respectively, from the tubes 38, 38', and 38", the spaces for the removal of the defective portions are shown in FIG. 9. It is now necessary to cut the fins from the tubes 38 with the aid of the heat exchanger fin remover 10. First, approximately three inches of fins are removed from the open end of the tube extending away from the boiler so than there is a clear, non-finned area available. (See FIG. 7). This step is repeated on the tubes 38'and 38" as shown in FIG. 9. Next the fins 36 are removed for a distance of about three inches from the part of the tube affixed to the main boiler as shown in FIG. 7, clearing a distance of approximately three inches. A replacement piece of tubing 58, 60, 62, approximately six inches longer than the length of the defective tubing removed, is then welded on both ends to the tubes 38, 38', and 38", respectively, thereby providing a continuous tube path. Preferably the replacement tubing 58, 60 and 62 has no fins thereon to make it easier to handle, however, fin replacement tubing can also be utilized if desired.

Hereinbefore has been described a heat exchanger fin remover and method of use therefor. It will be understood that various changes in the details, materials, arrangement of parts and operating conditions which have been herein described and illustrated in order to explain the nature of the invention may be made by those skilled in the art within the principles and scope of the instant invention.

While this invention has been described with reference to specific embodiments disclosed herein, it is not confined to the details set forth and the patent is intended to include modifications and changes which may come within and extend from the following claims.

I claim:

1. A heat exchanger fin remover comprising:

(A) a first hollow cylindrically-shaped member having a closed end and an open end;

(a) said first member closed end being provided with a centrally disposed portion having a centrally disposed threaded aperture therein adapted to be received by a rotary source of power, and (b) said first member open end being provided with an annular cutting ring portion disposed on the distal edge thereof; and (B) a second hollow cylindrically-shaped member having a closed end and an open end, said second member being adapted to be received within said first hollow cylindrically-shaped member open end;

(a) said second member closed end being provided with a threaded centrally disposed extending portion adapted to be received by and cooperate with said first member centrally disposed threaded aperture when said second member is inserted into said first member, and (b) said second member open end extending beyond said cutting ring portion disposed on the distal edge of said first member.

2. A heat exchanger fin remover, according to claim 1, wherein said rotary source of power is a portable milling machine chuck.

3. A heat exchanger fin remover, according to claim 1, wherein said first member cutting ring portion is diamond impregnated.

4. A heat exchanger fin remover, according to claim 1, wherein said first member cutting ring portion is carbon steel.

5. A heat exchanger fin remover, according to claim 1, wherein the diameter of said first member exceeds the diameter of said second member by an amount determined by the wall thickness of a heat exchanger tube.

6. A heat exchanger fin remover comprising:

(A) a first hollow cylindrically-shaped member having a closed end and an opened end;

(a) said first member closed end being provided with a centrally disposed shank having a centrally disposed threaded aperture therein adapted to be received by a chuck affixed to a portable milling machine, and (b) said first member open end being provided with an annular diamond impregnated ring portion disposed on the distal edge thereof; and (B) a second hollow cylindrically-shaped member having a closed end and an open end, said second member being adapted to be received within said first hollow cylindrically-shaped member open end;

(a) said second member closed end being provided with a threaded centrally disposed extending portion adapted to be received by and cooperate with said first member centrally disposed threaded aperture when said second member is inserted into said first member, and (b) said second member open end extending beyond said impregnated ring portion disposed on the distal edge of said first member, and (c) said first member having a diameter greater than the diameter of said second member.

7. A heat exchanger fin remover comprising:

(A) a first hollow cylindrically-shaped member having a closed end and an open end;

(a) said first member closed end being provided with a centrally disposed portion having a centrally disposed threaded aperture therein adapted to be received by a rotary source of power; and (b) said first member open end being provided with an annular cutting ring portion disposed on the distal edge thereof; and (B) a second solid cylindrically-shaped member, said second member being adapted to be received within said first hollow cylindrically-shaped member open end;

(a) said second member first end being provided with a threaded centrally disposed extending portion adapted to be received by and cooperate with said first member centrally disposed threaded aperture when said second member is inserted into said first member, and (b) said second member second end extending beyond said cutting ring portion disposed on the distal edge of said first member.

* * * * *